US007585187B2

(12) United States Patent
Daily et al.

(10) Patent No.: US 7,585,187 B2
(45) Date of Patent: Sep. 8, 2009

(54) LED SOCKET

(75) Inventors: Christopher George Daily, Harrisburg, PA (US); Sheldon Lynn Horst, Columbia, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 11/854,831

(22) Filed: Sep. 13, 2007

(65) Prior Publication Data

US 2009/0075519 A1 Mar. 19, 2009

(51) Int. Cl.
*H01R 13/66* (2006.01)

(52) U.S. Cl. ..... 439/620.02; 439/254; 362/640

(58) Field of Classification Search ..... 439/254, 439/670, 620.02; 362/649–650, 640, 652, 362/184

See application file for complete search history.

(56) References Cited

U.S. PATENT DOCUMENTS 2,118,503 A * 5/1938 Galvao ..... 439/254
5,057,982 A 10/1991 Hanami
5,350,322 A * 9/1994 Kondo ..... 439/862
6,227,679 B1 * 5/2001 Zhang et al. ..... 362/236
2007/0139948 A1 * 6/2007 Rawlings et al. ..... 362/548

FOREIGN PATENT DOCUMENTS

DE 199 52 132 5/2001
JP 54 042877 4/1979
JP 07 249467 9/1995

OTHER PUBLICATIONS

International Search Report; International Application No. PCT/US2008/010366; International Filing Date Sep. 4, 2008.

* cited by examiner

*Primary Examiner*—Briggitte R Hammond
*Assistant Examiner*—Vanessa Girardi

(57) ABSTRACT

A connector for mounting an LED to a printed circuit board (PCB) includes a hollow cylindrical body portion with an interior sidewall that defines a hollow cavity at one end to receive the LED threaded base section. The second end has a plurality of conductive contact elements with which to electrically contact the LED. A first electrical contact element includes at least one prong extending partially into the cavity. The prong is flexible for the threaded portion to pass the prong for insertion, and partially return to electrically engage the threaded portion to maintain the threaded portion inside the cavity. The prong also permits removal of the LED rotationally with respect to the cavity. The contact elements are in electrical communication with the LED and the threaded base section when the threaded base section is inserted within the body portion.

19 Claims, 6 Drawing Sheets

LED SOCKET

BACKGROUND

The present invention is directed to electronic components, and more particularly to a connector for mounting an LED to a printed circuit board (PCB).

The use of high intensity LEDs for general-purpose illumination, and in specialty lighting applications such as large signs and video display applications, has increased in recent years. Typically LEDs are mounted to PCBs by soldering them directly to the preprinted circuits. PCBs are most commonly manufactured using automated wave soldering techniques for mass production. If an LED fails after the PCB has been manufactured, the PCB is usually discarded and replaced with a replacement PCB, since field soldering of LEDs is, in most cases, inefficient and impractical. Although the cost of a replacement LED is negligible, the cost of labor and downtime associated with field soldering a replacement LED to a PCB is frequently greater than the cost to replace the entire PCB.

Some special purpose LED connectors have threaded bases and require machined assemblies to receive the threaded bases. These connectors feature multiple interconnecting parts. Internal threads must be machined in a connector body. Threaded LED terminations are accomplished by a screw action that is time consuming and adds to assembly costs. Moreover, the placement of the contacts on the PCB must be tightly controlled for the contact interfaces between the LEDs and the connectors to be reliable. Contact interfaces for the component parts of the PCBs may have a high variability in contact normal loads, which leads to early failures. Conversely, if the contact placement is tightly controlled, the fabrication costs may be greatly increased, making the devices impractical from a cost perspective.

What is needed is a connector to terminate a threaded LED that is reliable and permits the LED to be urged or snapped into position in the connector in a single motion. Other features and advantages will be made apparent from the present specification. The teachings disclosed extend to those embodiments that fall within the scope of the claims, regardless of whether they accomplish one or more of the aforementioned needs.

SUMMARY

In one embodiment, the present invention is directed to a connection receptacle for mounting a high powered LED having a threaded base section to a printed circuit board. The connection receptacle includes a hollow cylindrical body portion with an interior sidewall, a first end and a second end opposite the first end. The sidewall defines a hollow cavity adjacent the first end to receive the base section of the LED. The second end has a plurality of conductive contact elements configured to electrically contact the LED. A first electrical contact element includes at least one prong extending partially into the cavity. The prong is sufficiently flexible to allow the threaded portion to pass the at least one prong for insertion, and partially return to engage with the threaded portion to maintain the threaded portion inside the cavity. The prong also is configured to permit removal of the LED rotationally with respect to the cavity. The contact elements are in electrical communication with the LED and the threaded base section when the threaded base section is inserted within the body portion.

In another embodiment, the present invention is directed to LED assembly. The LED assembly includes an LED having a threaded base section and a core electrode in electrical communication. The core electrode is axially parallel to the threaded base section. A connection receptacle for receiving the LED includes a hollow cylindrical body portion with an interior sidewall, a first end and a second end opposite the first end. The sidewall defines a hollow cavity adjacent the first end to receive the base section of the LED. The second end has a plurality of conductive contact elements with which to electrically contact the LED. A first electrical contact element includes at least one prong extending partially into the cavity. The prong is sufficiently flexible to allow the threaded portion to pass the at least one prong for insertion, and partially return to engage with the threaded portion to maintain the threaded portion inside the cavity. The prong also is also configured to permit removal of the LED rotationally with respect to the cavity. The contact elements are in electrical communication with the LED and the threaded base section when the threaded base section is inserted within the body portion.

Other features and advantages of the present invention will be apparent from the following more detailed description of the preferred embodiment, taken in conjunction with the accompanying drawings which illustrate, by way of example, the principles of the invention.

BRIEF DESCRIPTION OF THE DRAWINGS

Wherever possible, the same reference numbers will be used throughout the drawings to refer to the same or like parts.

DETAILED DESCRIPTION OF THE INVENTION

Figure 1:
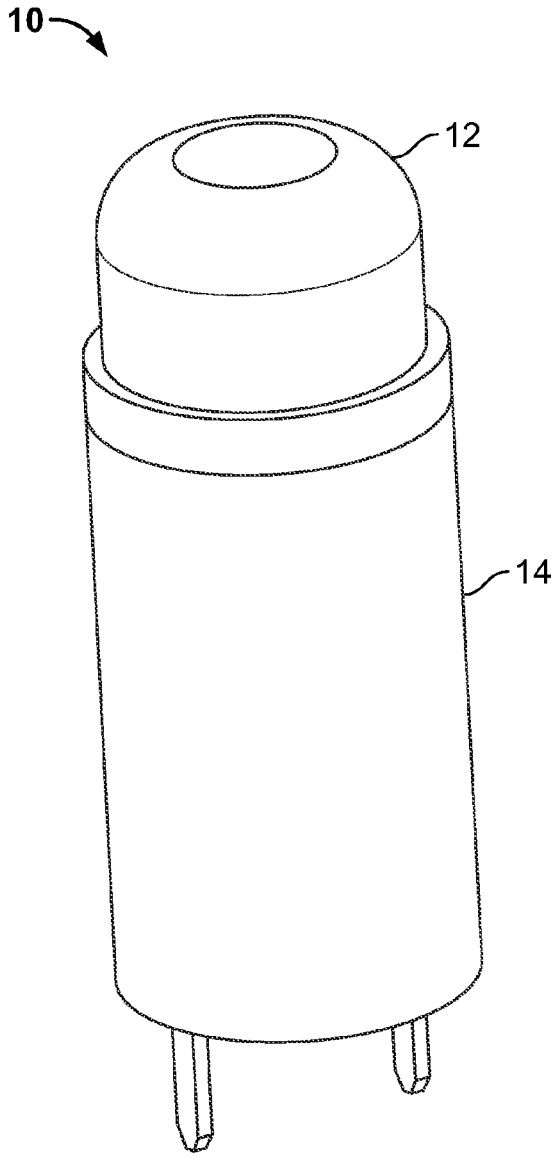
FIG. 1 is an upright perspective view of an LED/connector assembly.
Figure 2:
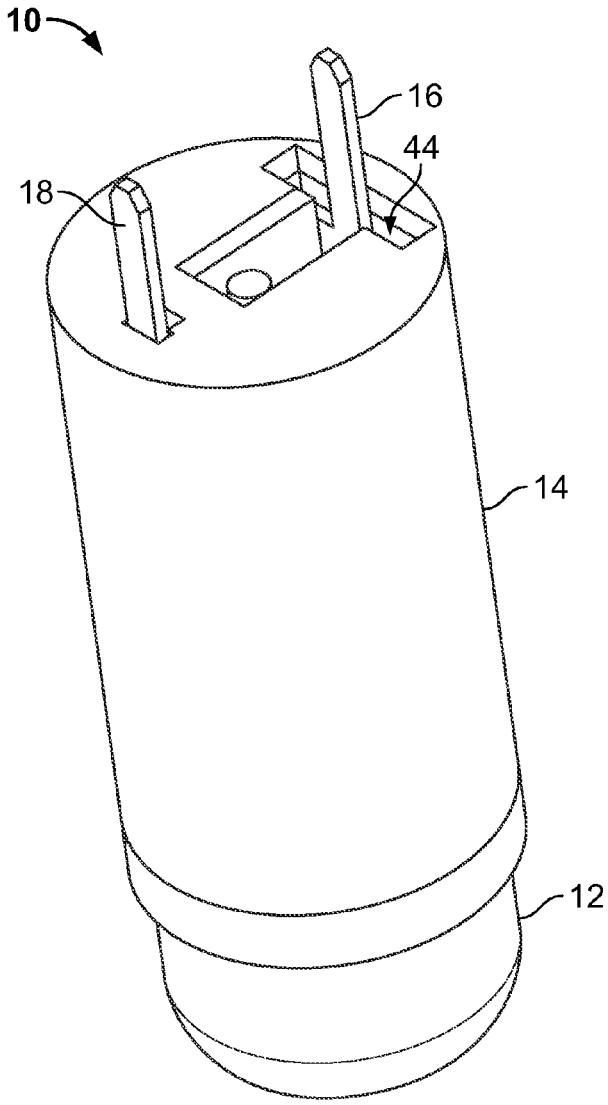
FIG. 2 is a reverse perspective view of an assembled LED/connector.
Figure 3:
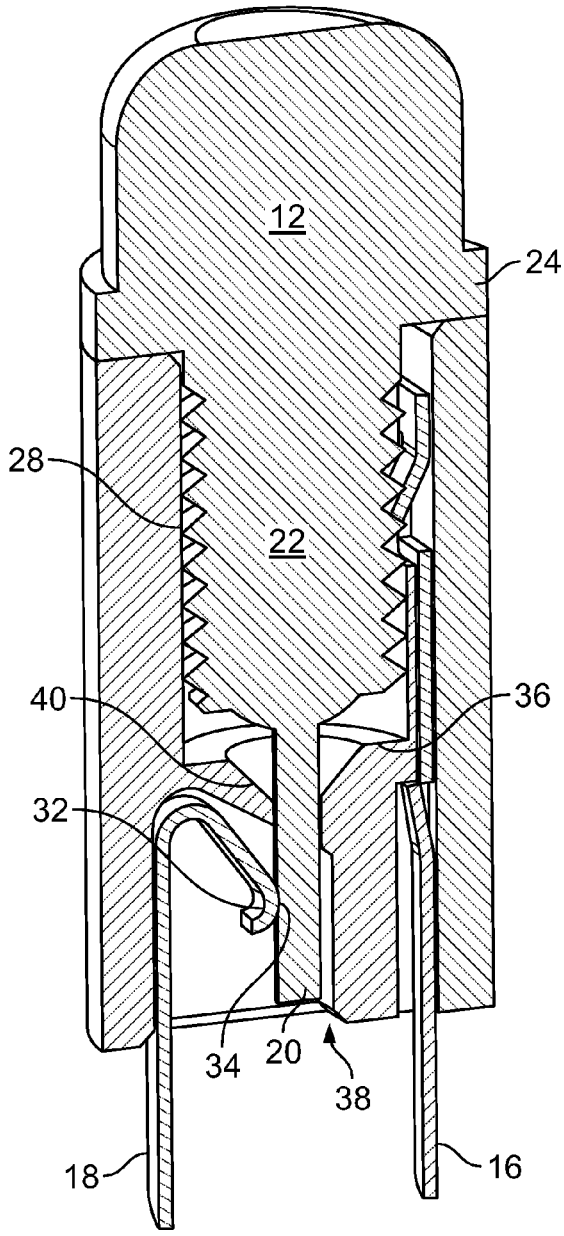
FIG. 3 is a cross-sectional view through the center of an assembled LED/connector.

Referring to FIGS. 1-3, an assembled LED/connector 10 includes an LED assembly 12 inserted into a connection receptacle 14. A pair of connector contacts 16, 18 protrude from the connection receptacle 14. A core LED electrode 20 extends through the center of the LED assembly 12 and provides an electrical connection to one of two internal LED terminals (not shown). A threaded base-portion 22 of the LED assembly 12 extends from a rim portion 24 that is electrically connected to the remaining internal LED terminal. The rim portion of the LED may be conductive, but is not required to be conductive for the connector to work properly. The internal LED of the LED assembly 12 is electrically connected between the threaded base portion 22 and the core LED electrode 20. The threaded base portion 22 and the core LED electrode 20 are otherwise insulated from each other to avoid short-circuiting the LED. An exemplary threaded-base integrated LED assembly 12 is manufactured by CAO Group, Inc., of West Jordan, Utah.

Figure 1A:
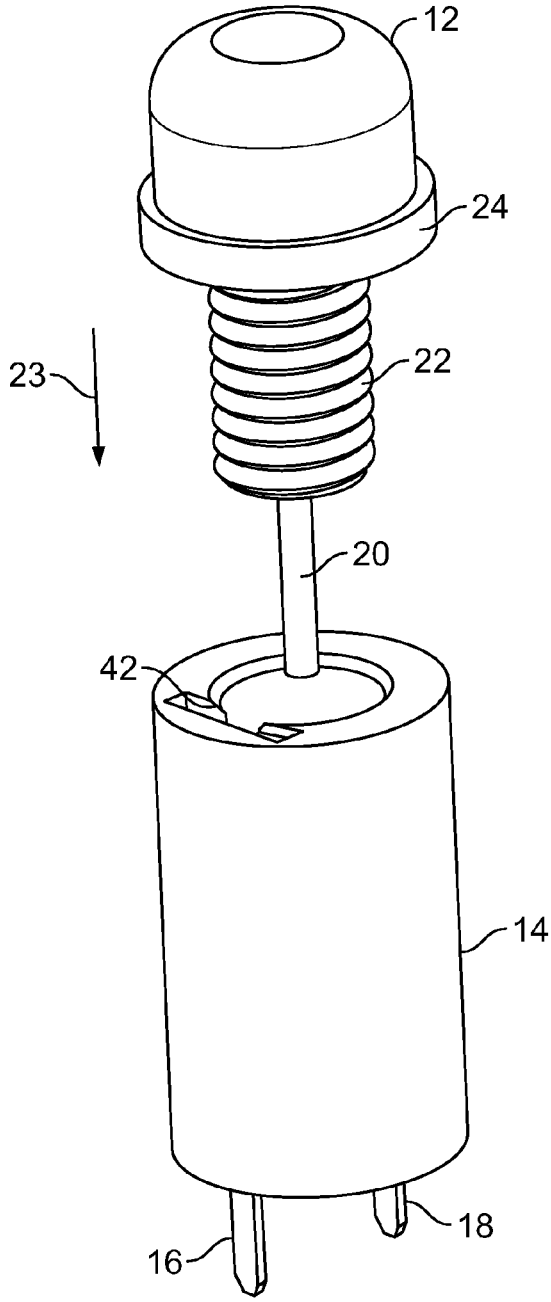
FIG. 1A is an exploded view of the the LED/connector assembly.

The connection receptacle 14 includes a hollow cylindrical cavity 26 that receives the threaded base portion 22. The interior cavity 26 of the connection receptacle 14 has a generally straight, smooth sidewall 28 with an inner-diameter that is slightly larger than the outer diameter of the threaded base portion 22 of the LED assembly 12, so that the threaded base portion 22 can be inserted into the connection receptacle 14 without rotation—i.e., by urging the LED assembly 12 directly downward into the interior cavity 26 of the connection receptacle 14, as indicated by direction arrow 23 in FIG. 1A.

Once the LED assembly 12 is urged into the connection receptacle 14, a pair of contact elements 16, 18 engage the core threaded base portion 22 and the core LED electrode 20, respectively. The first contact element 16 includes a deflectable prong 30. The first contact element 16 may be made from electrically conductive structures, such as a metallic foil, e.g., copper alloy conductive strip. Preferably the foil strip is sufficiently flexible to permit the prong 30 to deflect as the threaded base portion 22 is urged into the cavity 26. The prong 30 engages one of the threads of the threaded base portion 22, which provides electrical contact and prevents the LED assembly 12 from backing out of the cavity 26. The LED assembly 12 is secured in position by the prong 30, and is removable by conventional rotational means—i.e., by rotating the threaded base portion 22 of the LED assembly 12 in the direction in which it is configured to reverse, typically counterclockwise, although opposite-hand thread types exist and function much the same, with opposite rotation for installation and removal. Thus, the LED assembly 12 is installable in the connection receptacle 14 by simply urging it into the cavity 26, but removable only by rotating it in the appropriate direction.

The second contact element 18 includes an end portion 32 that is bent or turned back at an acute angle to the contact element 18. The end portion 32 has an inwardly curved tip portion 34. The end portion 32 is elastically deflectable, similar to the prong 30 and engages the core LED electrode 20 when the LED assembly 12 is pressed into the cavity 26. The curvature of the tip portion 34 allows the LED electrode 20 to slidingly engage the end portion 32 in both directions of movement, i.e., so that the end portion 32 does not gouge into the core electrode 20 and prevent its removal.

The cavity 26 has an inwardly protruding ledge 36 disposed intermediately of the opposite ends of the connection receptacle 14. The ledge 36 reduces the inner radius of the cavity 26 to trap the core LED electrode 20 and guide it into the lower cavity portion 38. Preferably, there is a tapered transition segment 40 that connects the lower cavity portion 38 with the ledge 36, and which helps to center the end of the core electrode into the lower cavity portion 38. The lower cavity portion 38 has an internal diameter that preferably provides a close clearance fit for the core LED electrode. The end portion 32 protrudes at least partially into the lower cavity portion 38 and presses against the core electrode 20 under spring tension. The flex in the second contact portion 18 from the bent intersection with the end portion 32 provides the spring tension.

Figure 5:
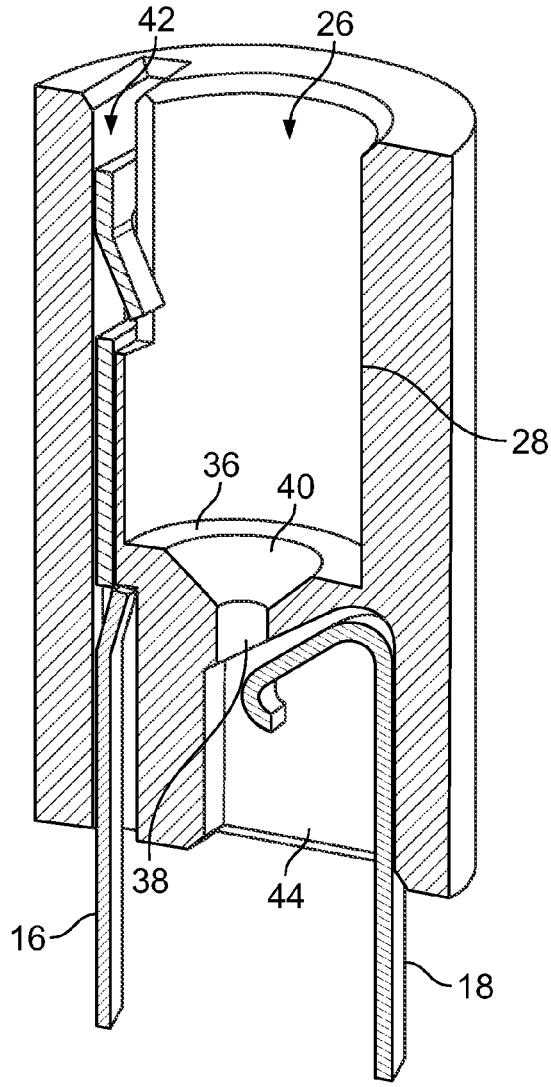
FIG. 5 is a cross-sectional view of the connector portion.
Figure 6:
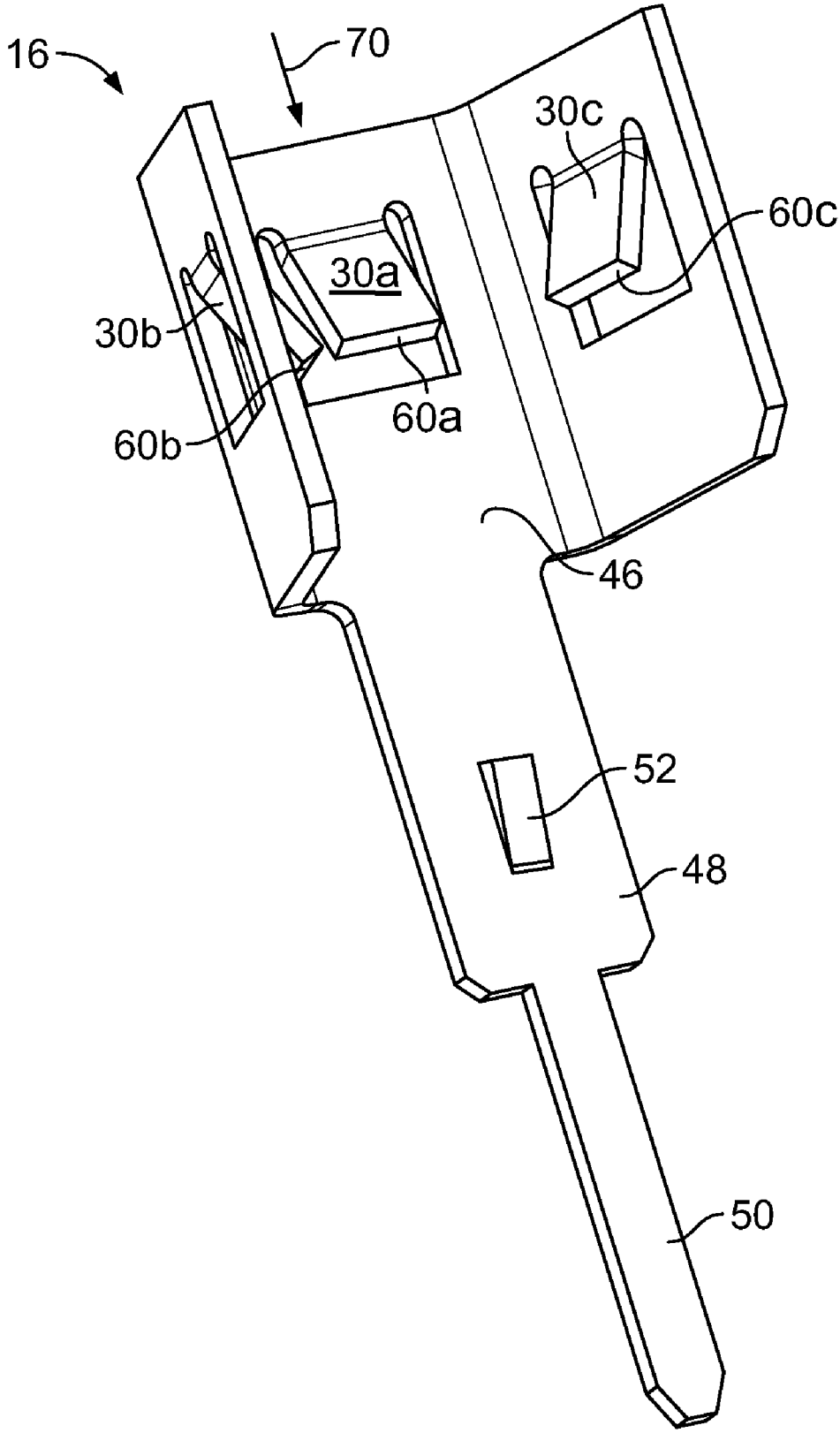
FIG. 6 is a perspective view of an alternate contact portion having 3-prongs.

Referring next to FIGS. 5 and 6, the connection receptacle 14 is preferably made of a molded, high temperature resin, e.g., glass-filled, nylon 6,6 or other electrically insulating, high temperature resin, and includes a pair of internal channels 42, 44 arranged on opposite sides of the receptacle 14. The first contact element 16 is installed in the channel 42 that runs adjacent to both the upper cavity 26 and the lower cavity 38 and protrudes from the lower end of the connection receptacle 14. In one embodiment the first contact element 16 is a flat strip of metal conductor with three step portions 46, 48, 50 of progressive width. The step portion between 46 and 48 provides a stop limit for seating the contact element 16 when the element is placed in the receptacle 14. The contact element also has a pair of bent prongs 30, 52 that protrude inward. The first prong 30, as discussed above, retentively and electrically engages the threads on the threaded base portion 22. The first prong 30 is shown as a single protruding member, however, additional prongs may be included, e.g., two prongs or three prongs arranged in series, which are preferably spaced apart by a single-thread distance for improved engagement with a corresponding number of threads. The second prong 52 deflects to allow it to pass behind a portion of the inner wall of the cavity 26 and spring back to latch in position in an opening (not shown) adjacent to the ledge 36.

The second contact element 18 is inserted into a slot 44 in the connection receptacle 14 adjacent to the lower cavity 38. The contact element 18 includes an intermediate locking member 54, which slides into the slot 44 of the inner wall, and locks the contact element into position by engagement of detents 56 located on either edge of the locking member 54.

Figure 4:
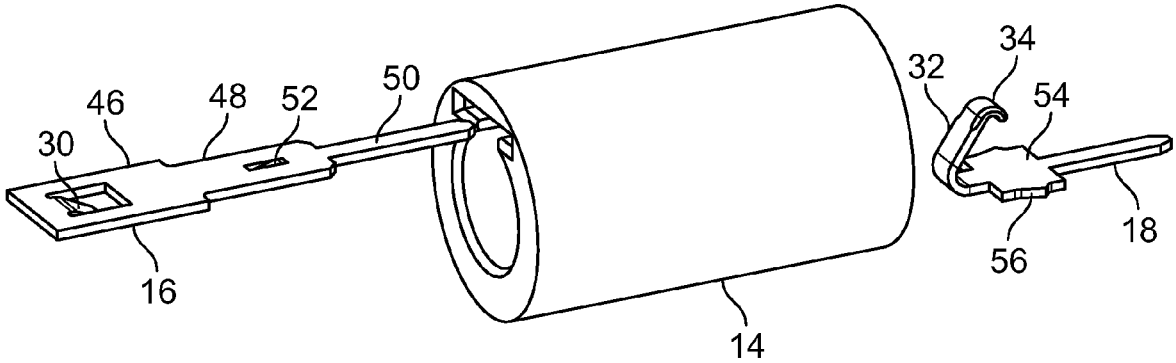
FIG. 4 is an exploded view of the connector portion.
Figure 7:
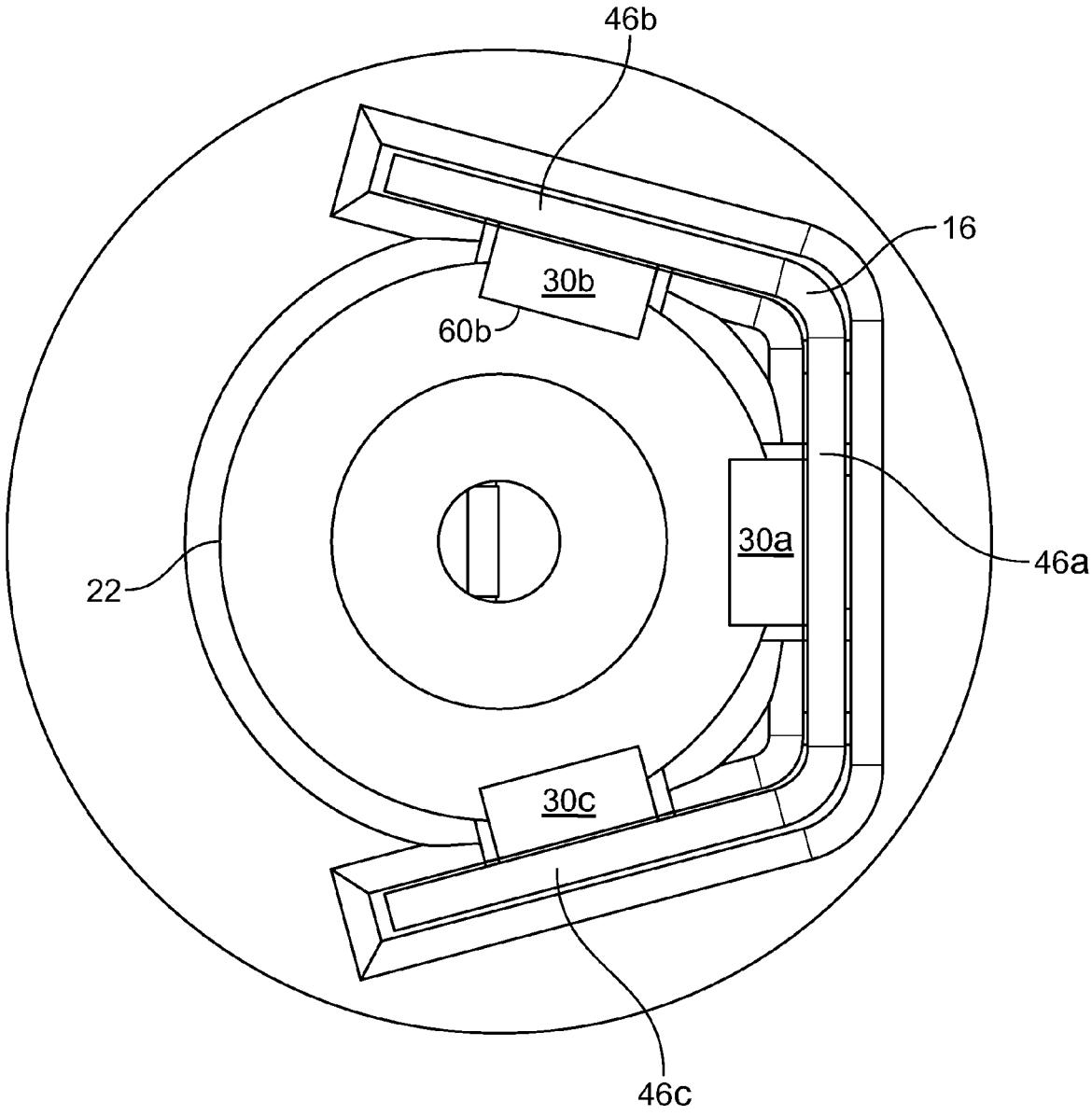
FIG. 7 is a top plan view of the connector portion.

Referring next to FIGS. 6 and 7, an alternate embodiment shows a novel 3-pronged contact to deflect and mate on threads. Contact portion 16 has three web portions 46*a*-46*c* which may be substituted for the single step portion 46 of the contact portion 16 shown in FIG. 4. Two prongs 46*b* and 46*c* project outwardly on opposite sides of the center prong 46*a* and are bent inwardly to partially envelop the circumference of the threaded portion 22. Deflectable prongs 30*a*-30*c* project inwardly from the respective web portions 46*a*-46*c* to engage the conductive threaded portion 22 of the LED assembly 12. The distal ends 60*a*-60*c* of prongs 30*a*-30*c*, respectively, may be staggered in length to engage the thread portion 22 approximately equally, to cooperate with the helical pitch of the individual threads. In this way, it is apparent that the prongs 30*a*-30*c* are deflected by the threaded portion 22 when the LED assembly 12 is inserted in a first direction indicated by arrow 70. The prongs 30*a*-30*c* then spring back and mate against the threads of the threaded portion 22 and act as ratchet pawls and electrical contacts to prevent the LED assembly 12 from backing out of the connection receptacle 14 linearly. However, the LED assembly 12 is rotatable about its axis, and can be removed in cooperation with the prongs 30*a*-30*c* by twisting in one rotational direction, as well as further tightened by twisting the threads in the opposite rotational direction. Thus, the LED assembly 12 may be securely installed into the connection receptacle 14 by a pushing motion, or by threading, but the LED assembly 12 is prevented from backing out of the connection receptacle 14 by the prongs 30*a*-30*c*, unless the threads 22 are used.

Figure 8:
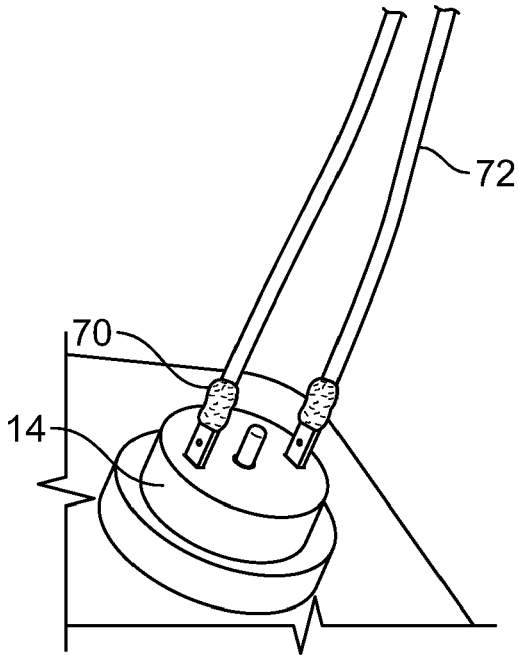
FIG. 8 is a perspective view of an alternate embodiment.
Figure 9:
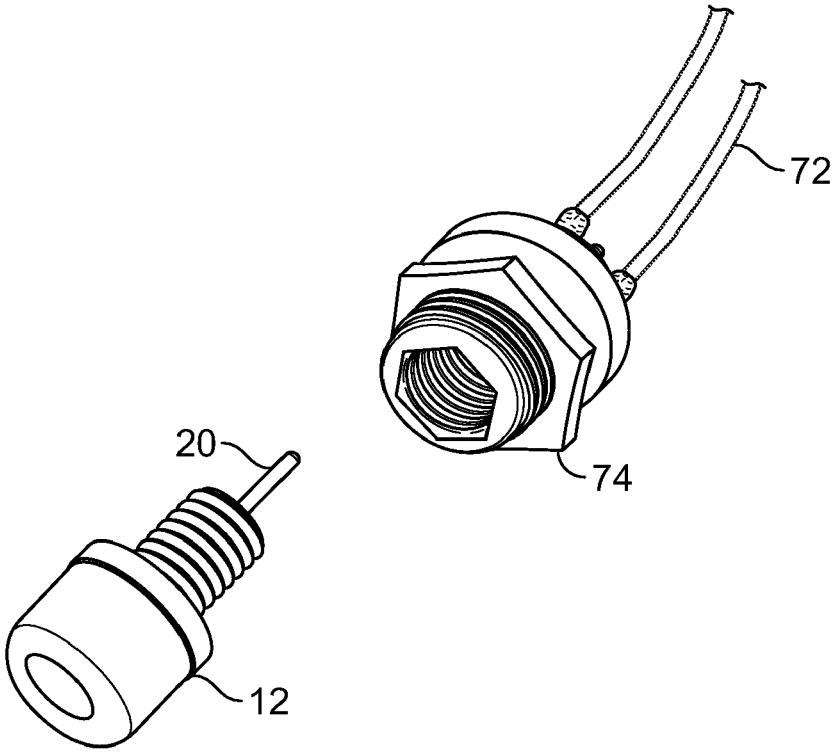
FIG. 9 is a perspective view of the alternate embodiment of FIG. 8, and an LED.

Referring next to FIGS. 8 and 9, in an alternate embodiment, the connector portion 14 may include solder terminals 70 for soldering wires 72 to the connector portion. The LED 12 is inserted into and removed from the connector portion 14 in the same manner as described above. In the embodiment of FIGS. 8 & 9, however, the connector portion 14 is configured for attaching leadwires 72 instead of the contact pins described above. The leadwires permit the connector portion 14 to be secured to a surface (not shown) other than a PCB, by a hex nut 74.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. A connection receptacle for mounting a high powered LED having a threaded base section comprises:

a hollow cylindrical body portion having an interior sidewall, a first end and a second end opposite the first end, the sidewall defining a hollow cavity adjacent the first end to receive the base section of the LED, and the second end having a plurality of conductive contact elements configured to electrically contact the LED; and an inwardly protruding ledge disposed intermediately of the first and second ends to support the threaded base section;

wherein a first electrical contact element of the plurality of contact elements includes at least one prong extending partially into the hollow cavity, the at least one prong being sufficiently flexible to allow the threaded portion to pass the at least one prong for insertion, and partially return to engage with at least one thread of the threaded portion to maintain the threaded base portion inside the hollow cavity; the at least one prong also being configured to permit removal of the LED rotationally with respect to the hollow cavity; and the plurality of contact elements being in electrical communication with the LED and the threaded base section when the threaded base section is inserted within the hollow cylindrical body portion.

2. The connection receptacle of claim 1, wherein the cylindrical body portion further includes a generally straight interior sidewall adjacent to the cavity, and the cavity has an inner-diameter slightly greater than the outer diameter of the threaded base section, wherein the threaded base section is close clearance fit with the sidewall when inserted into the cavity, and the threaded base portion is insertable into the connection receptacle by urging the LED assembly into the cavity.

3. The connection receptacle of claim 1, wherein the first contact element is disposed within the sidewall, and the at least one prong extends radially inward therefrom at an acute angle opposite a direction of insertion of the LED to allow the threaded section to slide within the sidewall in a direction of insertion, and to restrict the threaded section from sliding opposite the direction of insertion.

4. The connection receptacle of claim 1, wherein the plurality of contact elements engage the threaded base section and an axial core electrode of the LED when the LED is inserted into the connection receptacle.

5. The connection receptacle of claim 1, wherein the first contact element includes three deflectable prongs spaced around an inner radius of the sidewall and configured to engage three corresponding points of the threaded section.

6. The connection receptacle of claim 1, wherein the second contact portion end portion presses against a core electrode under spring tension generated from an intersection with a main beam and an end.

7. The connection receptacle of claim 1, wherein the first electrical contact element comprises a flat strip of a conductive metal having a width and a thickness, further comprising three progressive step portions, each progressive step portion producing a graduated width, supporting the contact element in the cavity sidewall.

8. The connection receptacle of claim 1, wherein the plurality of contact elements includes at least a second contact element protruding at least partially into a lower cavity portion, the second contact element having a longitudinal main beam and an end portion that is bent at an acute angle to the main beam in spring contact with an axial core electrode of the LED.

9. The connection receptacle of claim 8, wherein the end portion includes a distal tip portion curving toward the main beam and elastically deflectable to engage the core LED electrode when the LED is pressed into the cavity to permit the core LED electrode to slidingly contact the end portion in either direction of movement.

10. The connection receptacle of claim 8, further including a plurality of internal channels arranged on opposite sides of the receptacle to accept the first contact element and the at least one second contact element, wherein one channel receives the first contact element adjacent to both the upper cavity and the lower cavity and the first contact element protrudes from the lower end of the connection receptacle.

11. The connection receptacle of claim 10, wherein at least another channel receives at least one second contact element adjacent the lower cavity and the second contact element protrudes from the lower end of the connection receptacle.

12. The connection receptacle of claim 1, wherein the inwardly protruding ledge reduces an inner radius of the cavity to trap a core LED electrode and axially guide the core LED electrode into a lower cavity portion.

13. The connection receptacle of claim 12, also including a tapered transition portion between the lower cavity portion and the ledge, to guide the core electrode centrally into the lower cavity portion.

14. The connection receptacle of claim 12, in which the lower cavity portion includes an internal diameter configured for close clearance fit with the core LED electrode.

15. The connection receptacle of claim 1, wherein the connection receptacle is comprised of a molded, high temperature resin.

16. The connection receptacle of claim 15, wherein the high temperature resin is selected from the group consisting of glass-filled, nylon 6.6, and other electrically insulating, high temperature resins.

17. An LED assembly comprising:

an LED having a threaded base section and a core electrode in electrical communication, the core electrode disposed axially parallel to the threaded base section, and a connection receptacle for receiving the LED including:

a hollow cylindrical body portion having an interior sidewall, a first end and a second end opposite the first end, the sidewall defining a hollow cavity adjacent the first end to receive the base section of the LED, and the second end having a plurality of conductive contact elements configured to contact the LED;

wherein a first electrical contact element of the plurality of contact elements includes three contact prongs to deflect and mate on one or more threads of the threaded base portion a least one contact prong of the three contact prongs extending partially into the hollow cavity, the at least one prong of the three contact prongs being sufficiently flexible to allow the threaded base portion to pass the at least one prong for insertion, and partially return engage with at least one thread of the threaded base portion to maintain the threaded base portion inside the cavity; the at least one prong also being configured to permit removal of the LED rotationally with respect to the hollow cavity and the first contact element including three web portions, each web portion containing one of the three prongs; and a pair of outer web portions disposed on opposite sides of a centrally disposed web portion, each outer web portion of the pair of outer web portions bent inwardly to partially envelop the threaded portion; and at least one prong associated with each web portion of the pair of web portions projecting inwardly from the associated web portion to engage in electrical contact with the conductive threaded base portion when the threaded base section is inserted within the hollow cylindrical body portion.

18. The LED assembly of claim 17, wherein the cylindrical body portion further includes a generally straight interior sidewall adjacent to the cavity, and the cavity has an inner-diameter slightly greater than the outer diameter of the threaded base section, wherein the threaded base section is friction fit with the sidewall when inserted into the cavity, and the threaded base portion is insertable into the connection receptacle by urging the LED assembly into the cavity.

19. The LED assembly of claim 17, wherein the first contact element is disposed within the sidewall, and the at least one prong extends radially inward therefrom at an acute angle opposite a direction of insertion of the LED to allow the threaded section to slide within the sidewall in a direction of insertion, and to restrict the threaded section from sliding opposite the direction of insertion.

* * * * *